United States Patent [19]

Jones

[11] Patent Number: 4,488,659

[45] Date of Patent: Dec. 18, 1984

[54] COLLAPSIBLE CONTAINER

[76] Inventor: Gary L. Jones, 906 Melody La., Neosho, Mo. 64850

[21] Appl. No.: 374,482

[22] Filed: May 3, 1982

[51] Int. Cl.[3] ..... B65D 90/02; B65D 5/44

[52] U.S. Cl. ..... 220/416; 220/462; 229/41 R

[58] Field of Search ..... 220/403, 404, 416–418, 220/72, 74; 229/22, 26, 41 D, 52 AW, 23 R, 41 C

[56] References Cited

U.S. PATENT DOCUMENTS

| | | | |
|---|---|---|---|
| 2,002,493 | 5/1935 | Einson | 229/41 D X |
| 2,139,239 | 12/1938 | Mancuso | 224/41 D X |
| 2,220,110 | 11/1940 | Layton | 229/41 D |
| 2,483,464 | 10/1949 | Johnson | 229/52 A W X |
| 3,178,227 | 4/1965 | Snyder | 229/41 D X |
| 3,907,195 | 9/1975 | Struble | 229/41 D X |
| 4,094,457 | 6/1978 | Spillson | 229/41 C X |
| 4,313,547 | 2/1982 | Osborne | 220/416 |

FOREIGN PATENT DOCUMENTS

| | | | |
|---|---|---|---|
| 1481219 | 3/1966 | France | 229/22 |

*Primary Examiner*—Stephen Marcus
*Assistant Examiner*—Robert Petrik
*Attorney, Agent, or Firm*—Ziems, Walter & Shannon

[57] ABSTRACT

An insulated collapsible container suitable for a material handling box, equipment carrying case, food insulator, beverage insulator, trash receptacle, tote pail and the like, which is constructed from two flat blanks of structural material arranged for a high production rate. One blank forms a three sided collapsible structure including double walls, an inwardly folding bottom, a three position snap action lid hinge, an insert frame retaining clip, rim stiffeners, bail holes and hand holes. The remaining blank forms the mating insert frame around which two flexible liners are tightly placed, thus forming an insulating air entrapment therebetween. After pushing inward the bottom, container transformation from expanded to collapsed configuration is by inward movement of container sides. A flexible bail serves the dual purpose of container transport and retention of the collapsed state. The container is transformed from collapsed to expanded configuration by inward movement of front and back edges.

19 Claims, 22 Drawing Figures

COLLAPSIBLE CONTAINER

BACKGROUND OF THE INVENTION (a) Field of the Invention

The present invention relates primarily to three-sided, totally enclosed containers which, by hand, may be rapidly collapsed to conserve time and space during storage; and, which may be rapidly expanded by hand to form a lid-covered, structurally strong, liquid tight, space insulated container. Industrial material handling boxes, equipment carrying cases, insulated food and beverage containers, trash containers, and tote pails are product examples in this field.

(b) Description of the Prior Art

Totally enclosed collapsible and expandable containers are known in the art. However, the tendency is for time consuming modes of expansion, collapsing, and gaining interior access. Due to the requirement for collapsibility, liquid tightness and insulation tend to be ineffective, while structural rigidity is a common problem.

SUMMARY OF THE INVENTION

The present invention stems from the requirement to improve upon prior art in the field of invention. The invention includes two blanks arranged for high rate production. The blanks being a plurality of surfaces interconnected through a plurality of hinge lines. From one blank a double-walled, folding bottom, three-sided, collapsible container is formed by two interior and two exterior attachments. The container features several stiffeners, an insert frame retainer clip; a self-acting hinge, a three-position lid which serves to retain container in the expanded configuration and a flexible bail which also provides retention of the collapsed container configuration. The container is transformed from collapsed to expanded configuration by inward movement of the two exterior attachments. After pushing the bottom inward, container transformation from expanded to collapsed configuration is accomplished by inward movement of container sides adjacent to an exterior attachment. From the other of the blanks is formed a triangular insert frame around which double flexible liners are tightly placed, thus forming an air pocket therebetween, with said air pocket acting as an insulator. The insert frame containing the two flexible liners may be temporarily or permanently positioned in the insert frame retainer clip of subject container.

DETAILED DESCRIPTION OF THE PREFERRED EMBODIMENTS

Figure 1:
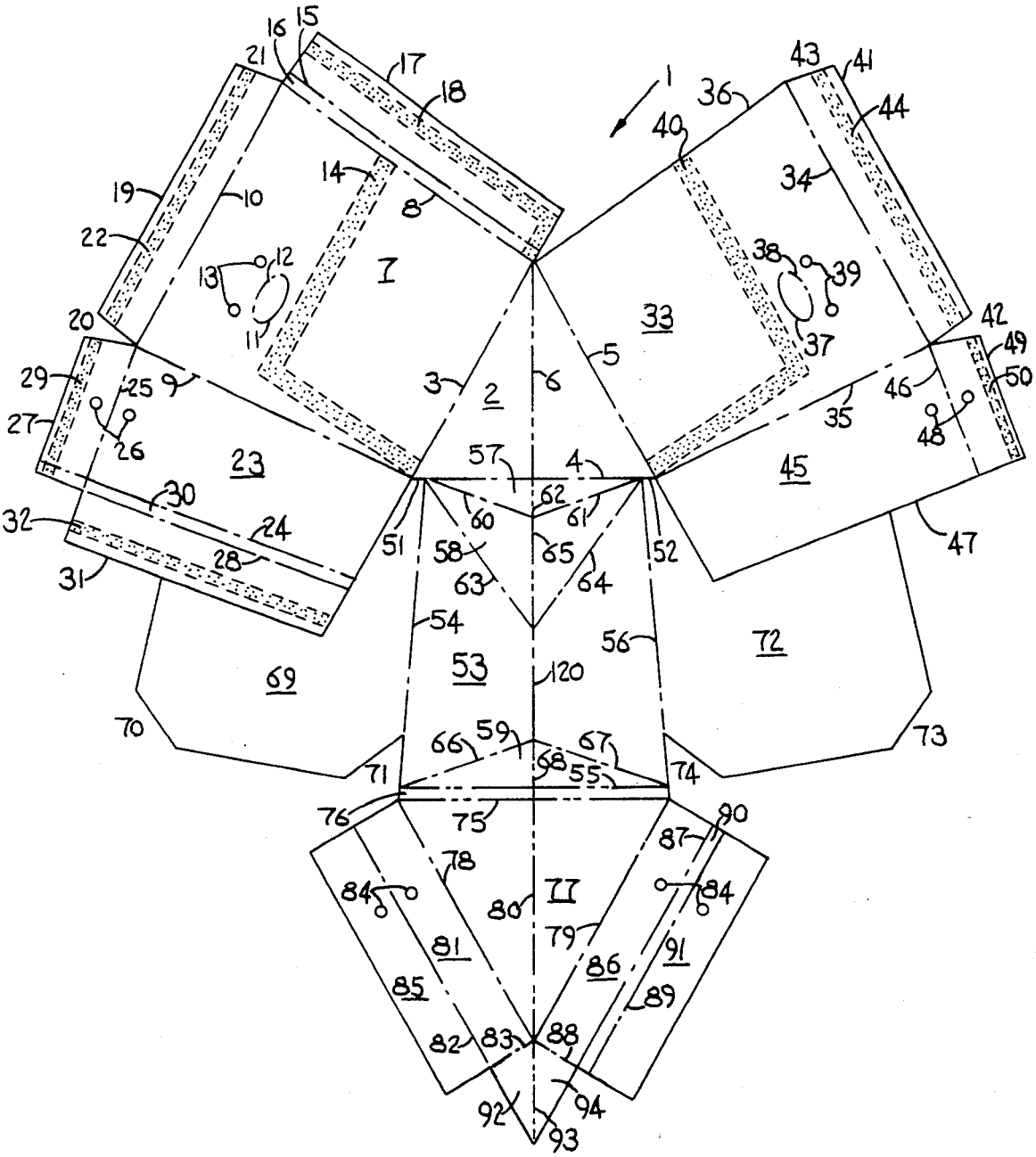
FIG. 1 is a plan view of a blank from which a container may be made embodying the principles of the invention.
Figure 3:
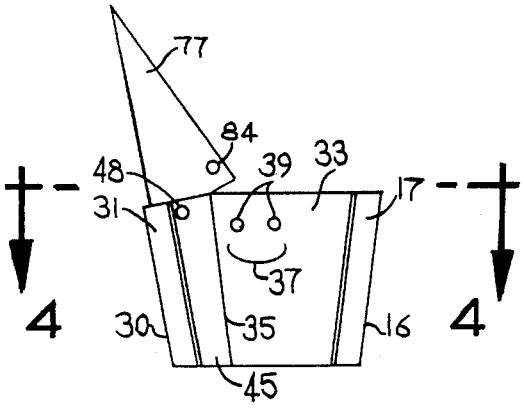
FIG. 3 is an elevation view of the constructed blank.

FIG. 1 shows blank 1 suitable for making a three-sided collapsible container embodying a collapsible bottom, double-walled sides, a self-acting hinge, handles, a three-position lid, bail and hang holes. The blank 1 materials may be of any combination which provides sufficient structural rigidity when scored, creased, hinged or connected by any suitable flexure material. The blank 1 surface attachment may be by any suitable fastening means. Referring specifically to FIG. 1 and generally to blanks within the detailed description of this patent, solid lines represent blank cut lines; alternately long and short dashed lines represent blank fold lines with adjacent surfaces bending up to construct, expand or operate subject blank embodiment; and, alternately long and double short dashed lines represent blank fold lines with adjacent surfaces bending down to construct, expand or operate subject blank embodiment.

In blank of FIG. 1 a triangular bottom 2 formed by fold lines 3, 4, 5 is intersected from vertex by hinge line 6. Through fold line 3, bottom 2 is attached to a quadrilateral exterior side 7 bounded by fold lines 8, 9, 10, 3. Enclosed within the exterior side 7 are a handle ellipse formed by cut line 11 and fold line 12, two bail holes 13, and an adhesive strip 14. Through generally parallel double fold lines 15, 8 forming a narrow strip 16, exterior side 7 is attached to a quadrilateral front attachment tab 17 extending from fold line 10 to fold line 3 with said tab 17 including adhesive strip 18. Through fold line 10 exterior side 7 is attached to a quadrilateral rim stiffener 19 extending from notch 20 at fold line 9 to bevel 21 at hinge line 8 with said rim stiffener 19 including adhesive strip 22. Through fold line 9, exterior side 7 is attached to a quadrilateral back tension member 23 bound by fold lines 24, 9, 25 and a cut line which is the general extension of hinge line 3 from fold line 9 to fold line 24. Said back tension member 23 contains hang hole 26. Through fold line 25 back tensor 23 is attached to a quadrilateral rim stiffener 27 extending from notch 20 at fold line 9 to fold line 28 with said rim stiffener 27 including adhesive strip 29, a portion of fold line 24, and hang hole 26. Through generally parallel double fold line 24, 28, forming a narrow strip 30, back tension member 23 is attached to a quadrilateral back attachment tab 31 bound by a fold line 28 and three cut lines. Two of the cut lines are the general extension of fold lines 25, 3. The tab 31 includes adhesive strip 32. Through fold line 5 is attached to bottom 2 a quadrilateral exterior side 33 bounded by fold lines 5, 34, 35 and cut line 36. Enclosed within the exterior side 33 is a handle elipse formed by cut line 37 and fold line 38, two bail holes 39; and an adhesive strip 40. Through fold line 34 exterior side 33 is attached to a quadrilateral rim stiffener 41 extending from notch 42 at fold line 35 to bevel 43 at cut line 36 with said rim stiffener 41 including adhesive strip 44. Through fold line 35 exterior side 33 is attached to a quadrilateral back tension member 45 bound by fold lines 35 and 46, a cut line which is the general extension of fold line 5; and cut line 47. The back tension member 45 contains hang hole 48. Through fold line 46 back tensor 45 is attached to a quadrilateral rim stiffener 49 extending from notch 42 at fold line 35 to cut line 47 with the stiffener 49 including adhesive strip 50 and hang hole 48. The remaining third side of triangular bottom 2 is a straight line consisting of fold line 4 and two substantially equal length off-set cut lines 51, 52 extending to fold lines 3, 5 respectively. Attached to the triangular bottom 2 through fold line 4 is a quadrilateral interior back 53 bound by fold lines 54, 55, 4, 56. Enclosed within said interior back 53 is a plurality of fold lines forming three fold line triangles 57, 58, 59. Relief fold line triangle 57 is formed by fold lines 60, 61, 4 and is intersected from vertex by fold line 62. Fold line triangle 58 is formed by fold lines 63, 64, 4; contains within its area relief fold line triangle 57; and is intersected by fold lines 62, 65 through vertex. Fold lines 6, 62, 65 form a straight line fold hereafter referred to as the lower straight line fold. Lid fold line triangle 59 is formed by fold lines 55, 66, 67. Fold line 68 intersects lid fold triangle 59 from vertex. Through fold line 54 interior side 69 is attached. Included on the boundaries of said interior side 69 is a corner bevel cut line 70, notch 71 with one side a portion of fold line 54, and relief cut line 51. Through fold line 56 interior side 72 is attached. Included on the boundaries of said interior side 72 is a corner bevel cut line 73, notch 74 with one side a portion of fold line 56, and relief cut 52. Through generally parallel double fold lines 75, 55 forming a narrow strip 76, interior back 53 is attached to triangular lid 77 formed by fold lines 78, 75, 79. Fold line 80 intersects said lid 77 from vertex. Fold lines 120, 68, 80 form a straight line fold hereafter referred to as the upper straight line fold. Note that the combination of fold lines 120, 80, 68 forming upper straight line fold do not necessarily form a straight line with the combination of fold lines 6, 62, 65 forming lower straight line fold. Through fold line 78, lid 77 is attached to quadrilateral lid stiffener 81. The stiffener 81 is bounded by a cut line and fold lines 78, 82, 83 with the stiffener containing bail hole 84. Attached to stiffener 81 through fold line 82 is quadrilateral stiffener 85 which includes bail hole 84 and is bounded by fold line 82 and three cut lines which form a mirror image of stiffener 81. Through fold line 79, lid 77 is attached to quadrilateral stiffener 86 with the stiffener 86 bounded by a cut line and fold lines 79, 87, 88. Stiffener 86 contains bail hole 84. Attached to stiffener 86 through generally parallel double fold lines 87, 89 forming narrow strip 90, is attached quadrilateral stiffener 91 which includes bail hole 84 and is bounded by fold line 89 and three cut lines which form a mirror image of stiffener 86. Through fold line 83, is attached tip triangle 92 bounded by fold lines 83, 93 and a cut line generally the extension of fold line 82. Through fold line 88, is attached tip triangle 94 bounded by fold lines 88, 93 and a cut line generally the extension of fold line 87.

Figure 2:
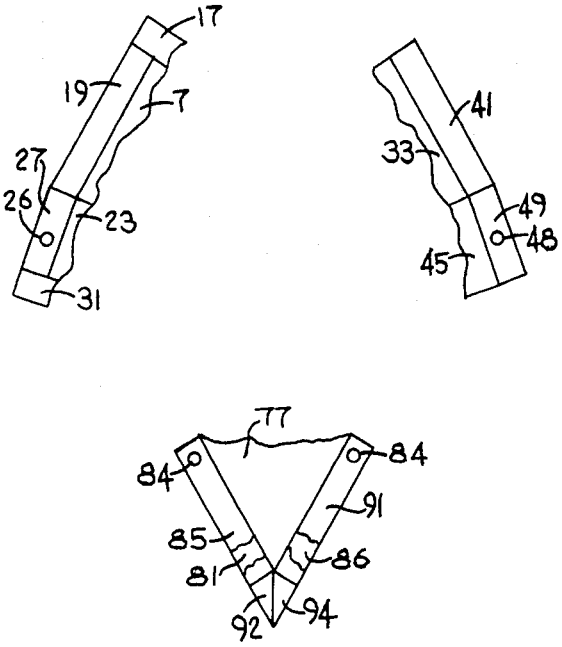
FIG. 2 is a plan view of the blank with stiffener flaps folded into position.

FIG. 2 is a plan view of blank 1, showing one embodiment with stiffeners 19, 27, 81, 86, 85, 91, 92, 94, 49, 41 in place after rotating around their respective fold lines as indicated by the blank 1 in FIG. 1. Only slight rotation has been given to stiffeners 81, 92, 94, 86.

Figure 4:
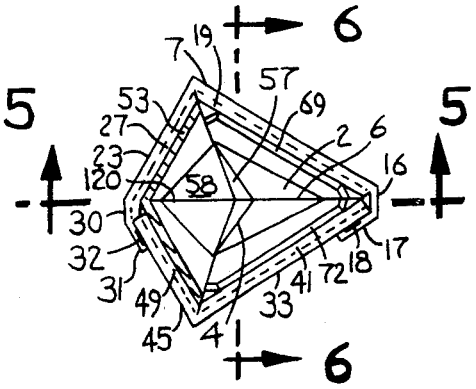
FIG. 4 is a horizontal section of the constructed blank taken on line 4—4 of FIG. 3.
Figure 6:
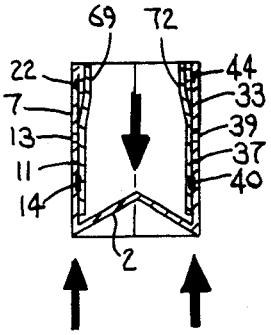
FIG. 6 is a vertical section of the constructed blank taken on line 6—6 of FIG. 4.
Figure 5:
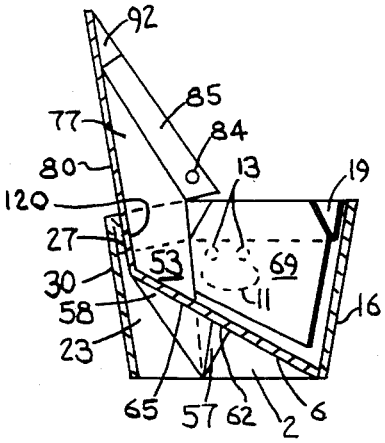
FIG. 5 is a vertical section of the constructed blank taken on line 5—5 of FIG. 4.

Shown in FIG. 3 through FIG. 6 the construction of this invention from blank 1 may be accomplished by making all bends as indicated by fold lines in FIG. 1 except those represented by fold lines 75, 55, 66, 67, 60, 61, 4; attaching interior side 69 to exterior side 7; attaching interior side 72 to exterior side 33; attaching tab 17 to exterior side 33; and attaching tab 31 to back tension member 45. During construction fold line 8 is placed on or near cut line 36 thus necessitating narrow strip 16 to allow wrap-around of blank 1 material thickness. Likewise, during construction, fold line 28 is placed on or near cut line 47 thus necessitating narrow strip 30 to allow wrap-around of blank 1 material thickness. Due to blank 1 material thickness, offset cut lines 51, 52 are necessary to allow positioning of interior sides 69, 72 against exterior sides 7, 33 respectively. Liquid tight construction results below adhesive strips 14, 40 when said strips 14, 40 are placed near cut line pattern of interior side quadrilaterals 69, 72. The constructed embodiment of blank 1 is displayed in FIG. 3 through FIG. 6. FIG. 6 shows the internal attachment of interior sides 69, 72 to exterior sides 7, 33 by adhesive strips 14, 40. FIG. 4 shows the exterior attachment of tab 17 to exterior side 33 through adhesive strip 18. FIG. 4 also shows the exterior attachment of tab 31 to back tension member 45 through adhesive strip 32. FIG. 4 and FIG. 5 displays the necessary condition that upon construction the combined length of fold lines 6, 62, 65 in combination with the relative positioning of interior sides 69, 72 with respect to exterior sides 7, 33 must be such that interior back 53 is in contact with stiffeners 27, 49 of back tension member 23, 45 near fold line 120 with said fold line 120 generally parallel with narrow strip 30. The expanded position shown in FIG. 7 can be made to be full or flat by controlling the combined lengths of back tension member 23, 45 relative to the length of interior back 53; relative positioning of the interior sides 69, 72 with respect to exterior sides 7, 33 respectively; and the procedure for attaching tab 31 to back tension member 45 establishes the expanded configuration of the embodiment shown in FIG. 7 and the characteristics of lid 77 operation shown in FIG. 9. In the expanded configuration it is important to assure built-in residual compression in interior back 53 and, in turn, built-in residual tension in back tension member 23, 45. Both expanded position and lid characteristics will be described later. Bail holes 13, 39 and handle ellipses 11, 37 are positioned in blank 1 so as to be centered over the centroid of the expanded container volume.

Figure 7:
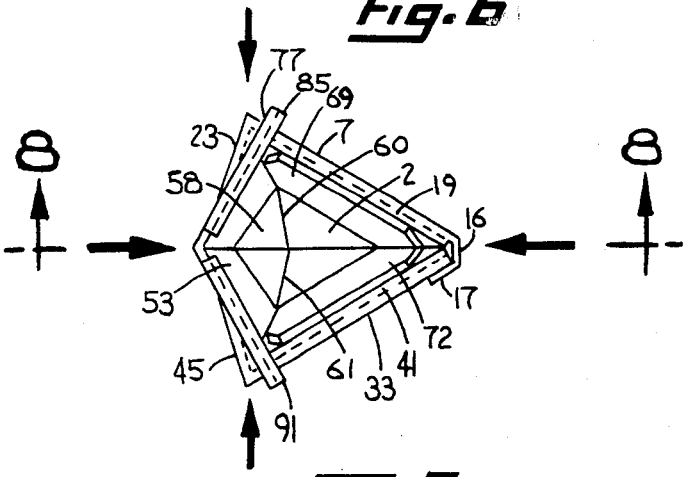
FIG. 7 is a plan view of the expanded blank construction.
Figure 8:
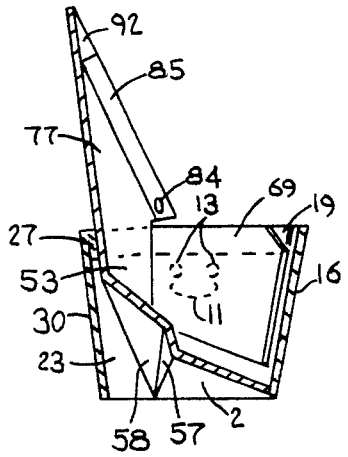
FIG. 8 is a vertical section of the expanded blank construction taken on line 8—8 of FIG. 7.

From FIG. 4 through FIG. 6, following construction, the embodiment is placed in a working configuration by pressing down on fold line 6 of triangular bottom 2 near relief triangle 57 and simultaneously pushing up on bottom edges of exterior side quadrilaterals 7, 33 as shown by arrows in FIG. 6. This results in the bending of fold lines 60, 61, 4 as indicated in blank 1 of FIG. 1 and also results in the working configuration of the embodiment shown in FIG. 7, FIG. 8, and FIG. 11. Two working configurations exist. The expanded configuration is shown in FIG. 7 which is attained by forcing the working embodiment into a self-standing position by momentarily pressing inward near external attachment tabs 31, 17 as shown by arrows in FIG. 7. The collapsed position is attained as shown in FIG. 7 by pushing inward near center of triangular bottom 2 while pushing inward near fold lines 9, 35 which is to say pushing inward on exterior side 7, 33 adjacent to exterior attachment 17, as shown by arrows in FIG. 7. From FIG. 9, when lid 77 is placed in back position 96, prior to forcing into collapsed position, the retained collapsed configuration shown in FIG. 11 can be achieved by the use of retainer band 97.

Figure 9:
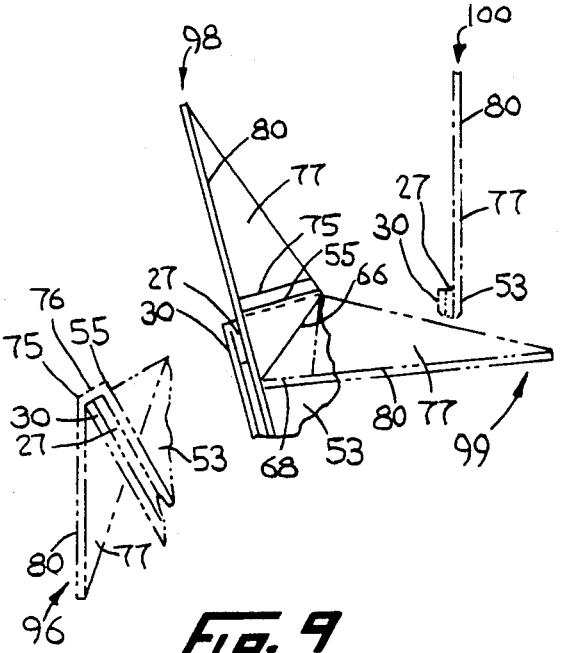
FIG. 9 is a view of the expanded blank construction showing the lid positions.
Figure 11:
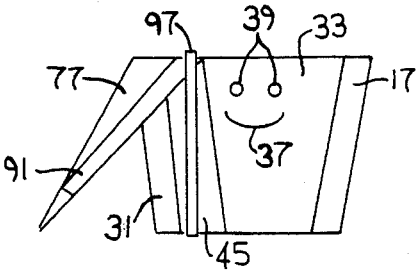
FIG. 11 is an elevation view of the blank construction in a collapsed state with band retainer.
Figure 10:
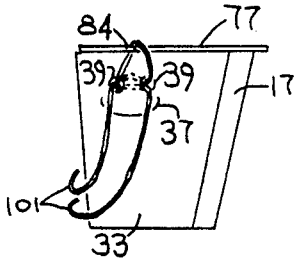
FIG. 10 is a side elevation of the blank configuration with a bail installed through both side and lid.
Figure 12:
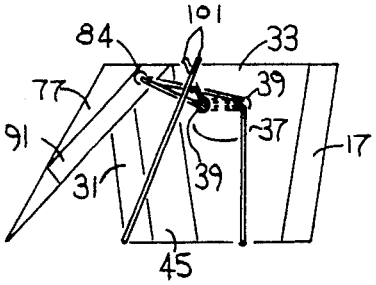
FIG. 12 is an elevation view of the blank construction in a collapsed state with the flexible bail retainer arrangement of FIG. 10.

While in the expanded configuration of FIG. 7, through a self-acting fold action, the lid 77 will snap to three definite positions 98, 99, 96 as shown in FIG. 9. As seen in the natural position 98, created during construction and following placement into the expanded position of FIG. 7, lid 77 is bent inward around fold line 80. As lid 77 is forced backward it gradually becomes flat until dead center position 100 is reached. At this position further backward movement will cause lid 77 to snap by embodiment self-action to back position 96 as lid 77 rotates around fold lines 75, 55 the spacing of which defines narrow strip 76 shown in blank 1 of FIG. 1. The width of narrow strip 76 in relation to the thickness of blank 1 material determines to some degree the location at which back position 96 will occur through a stopping action. As lid 77 moves toward back position 96, the lid 77 bends outward around fold line 80. Similar embodiment self-action will snap lid 77 to natural position 98 if lid 77 is forced forward slightly past dead center position 100. When lid 77 is forced forward from position 98 it gradually becomes flat until dead center position 100 is reached, at which position further forward movement will cause lid 77 to snap by embodiment self-action to position 99 as it rotates around fold lines 66, 67 and bends outward around fold line 80. Similar embodiment self-action will snap lid 77 to natural position 98 if forced backward slightly past dead center position 100. Position 96 is required to allow collapsing of embodiment as shown in FIG. 11. Position 98 may be utilized to retain lid 77 in open position and position 99 may be utilized to keep lid closed as well as lock embodiment into expanded position. The embodiment action of FIG. 9; the exact locations at which the lid 77 positions 98, 99, 100, 96 occur; and the force required or developed to move lid to positions 98, 99, 100, 96 depend on the resistance of the expanded embodiment to configuration change. Many factors may cause such resistance including relative positioning of interior sides 69, 72 with respect to exterior sides 7, 33 respectively; the residual compression in interior back 53 shown in FIG. 4; the width of narrow strip 76 shown in FIG. 1 and FIG. 9; fold line length 68 shown in FIG. 1 and FIG. 9; the blank 1 material; and internal pressure applied by container contents. FIG. 10 shows the expanded configuration with flexible loop bail 101 through bail holes 39, 13 in exterior sides 33, 7 respectively, and through lid 77 bail holes 84 in a figure eight fashion. Force on said bail 101 tends to close lid 77 by said arrangement. FIG. 12 shows the collapsed position of FIG. 10 embodiment with bail 101 acting as holding band. It is to be noted that the length of bail 101 is exactly that required to hold embodiment of FIG. 10 in tightly collapsed position by one loop around bottom and one loop crossed over top, then seated and held in place by corner notch formed by tab 31.

Figure 13:
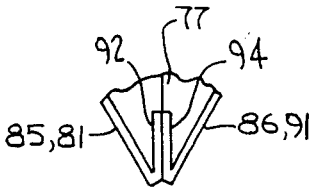
FIG. 13 is a plan view of the blank configuration with lid rims partially formed.
Figure 14:
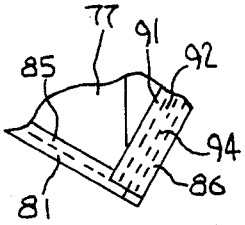
FIG. 14 is a plan view of the blank configuration with lid rims completely formed.
Figure 15:
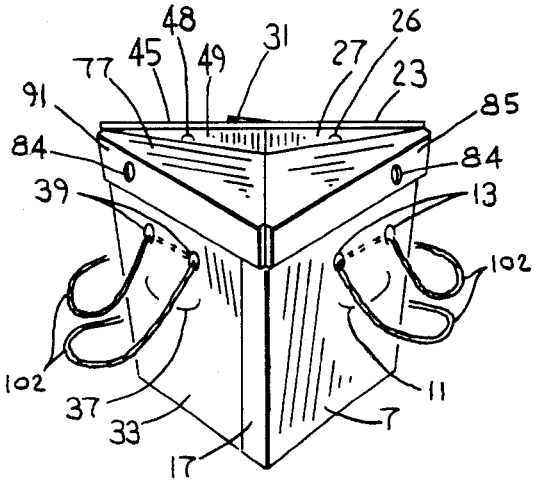
FIG. 15 is a perspective view of the expanded blank construction with flexible bail attached through sides.
Figure 16:
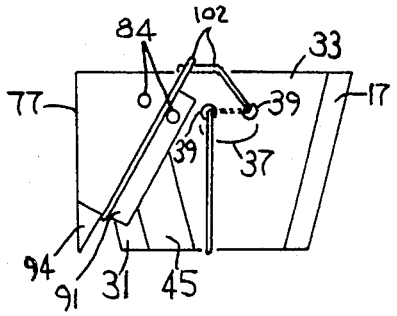
FIG. 16 is an elevation view of the blank construction in a collapsed state with the flexible bail retainer arrangement of FIG. 15.

Another embodiment of present invention is shown in FIG. 13 in which blank 1 has lid stiffeners 81, 85, 92, 94, 91, 86 partially positioned to form a rim. FIG. 14 is the completed lid rim of blank 1 showing quadrilaterals 81, 85, 86, 91 and triangles 92, 94 in finished position. FIG. 15 is the blank 1 embodiment of the subject invention with lid rim and flexible bail 102 installed therein. FIG. 16 shows the collapsed position of FIG. 15 embodiment with bail 102 acting as holding band. It is to be noted that the length of bail 102 is exactly that required to hold embodiment of FIG. 15 in tightly collapsed position by one loop 102 around bottom and one loop 102 crossed over top, then seated and held in place in notch formed by 91, 85, 92, 94.

Figure 22:
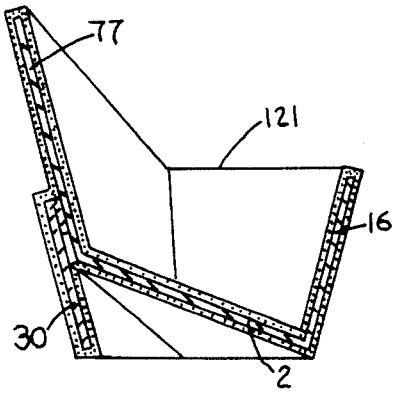
FIG. 22 is a vertical section detail of the expanded blank construction enclosed in flexible cover.

FIG. 22 shows another embodiment of blank 1 in which a flexible liner 121 encloses all surfaces visually exposed in both collapsed and expanded configuration.

Figure 17:
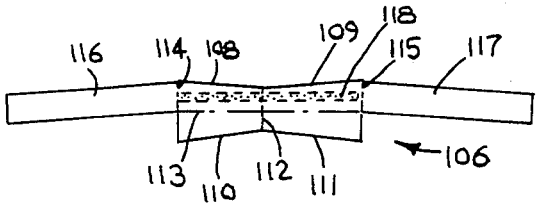
FIG. 17 is a plan view of a blank from which a liner frame may be made embodying the principles of the invention.
Figure 20:
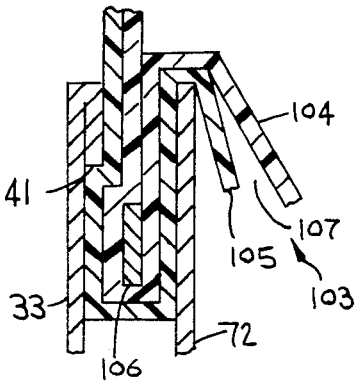
FIG. 20 is a vertical section detail of a liner, liner frame and frame retainer clip.
Figure 18:
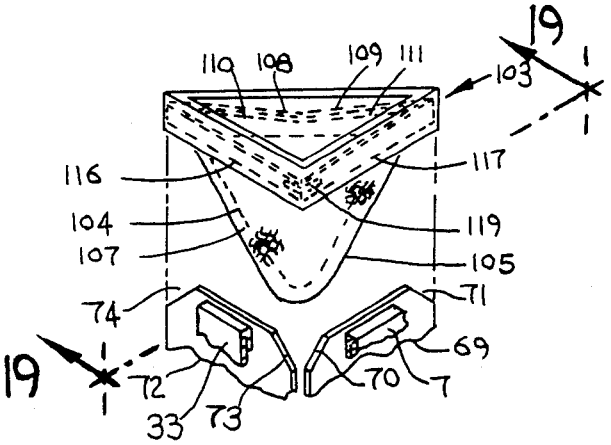
FIG. 18 is an exploded perspective view showing a liner, liner frame and frame installation.
Figure 21:
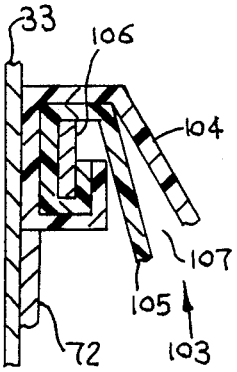
FIG. 21 is a vertical section detail of a liner, liner frame and frame retainer clip.
Figure 19:
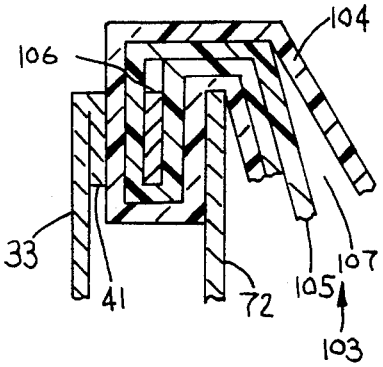
FIG. 19 is a vertical section of a liner, liner frame and frame retainer clip taken on line 19—19 of FIG. 18.

Shown in FIG. 17 through FIG. 21, an embodiment of this invention is the attachment of a flexible insert 103 consisting of two flexible liners 104, 105 stretched tightly over a frame 106 forming a trapped air pocket insulator 107. The embodiments of this invention provides for the attachment of a flexible liner such as that of FIG. 18. FIG. 17 shows the plan view of frame blank 106 which is utilized to form the flexible insert 103 of FIG. 18. Frame blank 106 of FIG. 17 is further defined through utilizing the line convention previously established for blanks of this invention. Said frame 106 materials may be of any combination which provides sufficient rigidity when scored, creased hinged or connected by any suitable flexure material. Blank 106 consists of four quadrilaterals 108, 109, 110, 111 attached at fold lines 112, 113. Attached to quadrilaterals 108, 109 through fold lines 114, 115, are quadrilaterals 116, 117 respectively. Adhesive strip 118 is attached to quadrilaterals 109, 108. Formation of the blank 106 into the frame embodiment is accomplished by bending on the fold lines as shown in FIG. 17. FIG. 18 shows the frame embodiment in which quadrilaterals 110, 111 are fixed to quadrilaterals 109, 108 respectively through adhesive strip 118. Quadrilaterals 117, 116 are fixed by tab 119 at edge opposite fold lines 115, 114 respectively thus forming a triangular embodiment from blank 106. In FIG. 17 blank 106, all quadrilaterals and crease lines are proportioned through coordination with the embodiment of blank 1 shown in FIG. 1 such that insert 103 fits tightly flush inside container embodiment of blank 1 of FIG. 1. Referring to blank 1 of FIG. 1 and blank 106 of FIG. 17, frame quadrilaterals 108, 109 match interior back 53 with fold line 112 overlaying hinge line 120 thus allowing frame embodiment 106 to conform to the configuration of blank 1 embodiment. As shown in FIG. 18, exterior sides 33, 7 and interior sides 72, 69 including respective notches 74, 71 and bevels 73, 70 provide for position guidance of insert 103 into retainer clip formed thereby. FIG. 19 shows one arrangement in which clip spring action between exterior sides 33, 7 and interior sides 72, 69 respectively, retain insert 103. FIG. 20 is another retainer clip arrangement in which insert 103 is retained against upward movement. FIG. 21 displays a retainer clip of the present invention in which insert 103 is retained against downward movement with flush fitting action providing further clamping. FIG. 19 insert 103 is wrapped from air pocket counterclockwise around frame 106. FIG. 20 shows insert 103 wrapped from air pocket clockwise around frame 106.

Thus, it will be appreciated that, as a result of the present invention, a blank and collapsible container are provided by which objectives of the invention are fulfilled. Also, it will be understood from the preceding description that modifications may be made in the illustrated embodiments without departure from the invention. Accordingly, it is expressly intended that the foregoing description and accompanying drawings are illustrative only, not limiting, and that the true spirit and scope of the present invention is to be determined by reference to the appended claims.

What is claimed is:

1. A collapsible container cut and folded from a single blank of corrugated paperboard or the like, comprising:

a triangular bottom panel having a fold line;

a plurality of exterior side panels foldably attached to said triangular bottom panel;

a quadrilateral interior back panel foldably attached to said triangular bottom panel and having an intermediate fold line intersecting said fold line of said triangular bottom panel;

a plurality of interior side panels foldably attached to said quadrilateral interior back panel and positioned on interior sides of said exterior side panels; and a lid foldably attached to said quadrilateral interior back panel along a top line, wherein said quadrilateral back portion includes a plurality of triangular arrangements of fold lines including a first triangular arrangement having a first base coincident with said top line and a first vertex lying on said intermediate fold line, a second triangular arrangement having a second base coincident with said bottom line and a second vertex lying said intermediate fold line, and a third triangular arrangement having a base coincident with said bottom line and a third vertex lying on said intermediate fold line between said first vertex and said second vertex.

2. The collapsible container of claim 1, further comprising a plurality of back tension panels, each back tension panel being foldably attached to one of said exterior side panels, and positioned on an exterior side of said quadrilateral interior back panel, and an attachment tab foldably attached to one of said back tension panels for securing together said back tension panels.

3. The collapsible container of claim 1, further comprising a plurality of quadrilateral stiffeners, one of said stiffeners being foldably attached to each of said exterior side panels and said back tension panels.

4. The collapsible container of claim 1, wherein said lid is triangular and includes a stiffener foldably attached along two sides of the lid.

5. The collapsible container of claim 1, further comprising means for retaining said container in the collapsed state.

6. The collapsible container of claim 5, wherein said retaining means includes a flexible bail.

7. The collapsible container of claim 5, wherein said retaining means includes a band.

8. The collapsible container of claim 1, further comprising a plurality of flexible liners.

9. The collapsible container of claim 8, wherein an insulating space is defined in the interior of said container, and on an exterior side of said flexible liners.

10. The collapsible container of claim 8, further comprising a substantially triangular frame positioned within and conforming to said container.

11. The collapsible container of claim 10, wherein said flexible liners are secured by said frame.

12. The collapsible container of claim 10, further comprising means for positioning said frame in said container.

13. The collapsible container of claim 12, wherein said positioning means includes said exterior side panels and said interior side panels.

14. The collapsible container of claim 1, further comprising a flexible cover enclosing said container.

15. The collapsible container of claim 1 wherein each of said exterior side panels include hand holes.

16. The collapsible container of claim 1 wherein each of said exterior side panels and lid stiffeners include bail holes.

17. The collapsible container of claim 1 wherein each of said back tension panels include hang holes.

18. The collapsible container of claim 16 wherein said bail holes include one flexible bail looped through each.

19. A blank of corrugated paperboard or the like for folding into a collapsible container with an integral lid comprising:

a central portion defined by a quadrilateral arrangement of fold lines;

three triangular arrangements of fold lines defined within said quadrilateral arrangement, wherein a first of said triangular arrangements has a first base coincident with one of the fold lines of said quadrilateral arrangement and a first vertex positioned on said central portion inwardly from said first base, a second of said triangular arrangements has a second base coincident with a fold line of said quadrilateral arrangement which is opposite said one of the fold lines and a second vertex positioned on said central portion inwardly from said second base, and a third of said trianglar arrangements has a third base coincident with said second base and a third vertex positioned on said central portion inwardly from said second base farther than said vertex of said triangular arrangement;

an intermediate fold line in said central portion, intersecting said first, second and third vertices;

two interior side panels, each attached to said central portion along one of the fold lines of said quadrilateral arrangement;

a triangular bottom panel having first, second and third bases, said first base being attached to said central portion along said opposite fold line of said quadrilateral arrangement, said triangular bottom panel having a fold line collinear with said intermediate fold line in said central portion;

two exterior side panels, each attached to said triangular bottom panel along one of said second and third bases, said second and third bases being defined by fold lines;

two back tension panels, one of said back tension panels being attached to one of said exterior side panels, and the other of said back tension panels being attached to the other of said exterior side panels, each of said back tension panels being separated from said interior side panels by cut lines; and a lid panel attached to said central portion along said first base of said first triangular arrangement of fold lines.

* * * * *